US007744084B2

(12) United States Patent
Zimmermann

(10) Patent No.: US 7,744,084 B2
(45) Date of Patent: Jun. 29, 2010

(54) METHOD AND DEVICE FOR DIVERTING FLAT OBJECTS

(75) Inventor: Armin Zimmermann, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 376 days.

(21) Appl. No.: 11/999,691

(22) Filed: Dec. 6, 2007

(65) Prior Publication Data

US 2008/0211178 A1 Sep. 4, 2008

(30) Foreign Application Priority Data

Dec. 7, 2006 (DE) ..... 10 2006 057 776

(51) Int. Cl.
*B65H 33/12* (2006.01)

(52) U.S. Cl. ..... 271/176; 271/306

(58) Field of Classification Search ..... 271/306, 271/176

See application file for complete search history.

(56) References Cited

U.S. PATENT DOCUMENTS 3,606,311 A * 9/1971 Yoshimura ..... 271/177
3,729,191 A * 4/1973 Yoshimura et al. ..... 271/179
3,814,415 A * 6/1974 Hunter et al. ..... 271/181
4,245,832 A 1/1981 Klenk et al.
4,285,513 A * 8/1981 Kwasnitza ..... 271/270
4,462,587 A * 7/1984 Graef et al. ..... 271/263
4,776,578 A * 10/1988 Hirakawa et al. ..... 271/223
4,863,154 A * 9/1989 Hirakawa et al. ..... 271/176
4,964,982 A 10/1990 Goldkuhle et al.
5,115,918 A * 5/1992 DeWitt et al. ..... 209/3.1
5,464,099 A * 11/1995 Stevens et al. ..... 209/3.1
6,179,284 B1 1/2001 Maertin et al.
6,196,537 B1 3/2001 Conner et al.
6,623,001 B2 * 9/2003 Steinkogler et al. ..... 271/176

(Continued)

FOREIGN PATENT DOCUMENTS

DE 3723259 A1 1/1989

(Continued)

OTHER PUBLICATIONS

Derwent Abstract—DE-42 16 146 C1; Dec. 2, 1993; Licentia Patent-Verwaltungs-GmbH, 60596 Frankfurt, Germany.

*Primary Examiner*—Patrick Mackey
*Assistant Examiner*—Howard Sanders
(74) *Attorney, Agent, or Firm*—Laurence A. Greenberg; Werner H. Stemer; Ralph E. Locher

(57) ABSTRACT

In a transport method, a leading object is diverted from an initial direction to a target direction and transported and stopped by a guiding facility. If the following object has reached a specific position during transport in the initial direction, the guiding facility triggers continuation of the transport of the leading object, diverts the following object to the target direction, and transports the following object in the target direction. If a determined sum of the thicknesses of the objects is less than or equal to a predetermined thickness limit, continuation of the transport of the leading object is triggered such that the following object moves onto the leading object when diverted and overlaps the leading object when transported in the target direction. If the thickness sum is greater than the thickness limit, continuation of the transport of the leading object is triggered such that a gap exists between the objects.

16 Claims, 5 Drawing Sheets

U.S. PATENT DOCUMENTS

| | | | | |
|---|---|---|---|---|
| 6,631,896 | B2 * | 10/2003 | Yamada et al. | 270/58.09 |
| 2005/0280833 | A1 | 12/2005 | Dian et al. | |
| 2006/0249438 | A1 | 11/2006 | Schwarzbauer et al. | |

FOREIGN PATENT DOCUMENTS

| | | | |
|---|---|---|---|
| DE | 4216146 | C1 | 12/1993 |
| DE | 19953085 | A1 | 5/2000 |
| EP | 0569662 | B1 | 10/1996 |
| EP | 0915051 | A1 | 5/1999 |

* cited by examiner

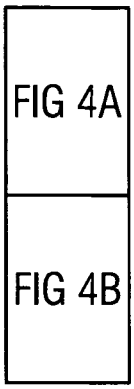
FIG 4
FIG 4A
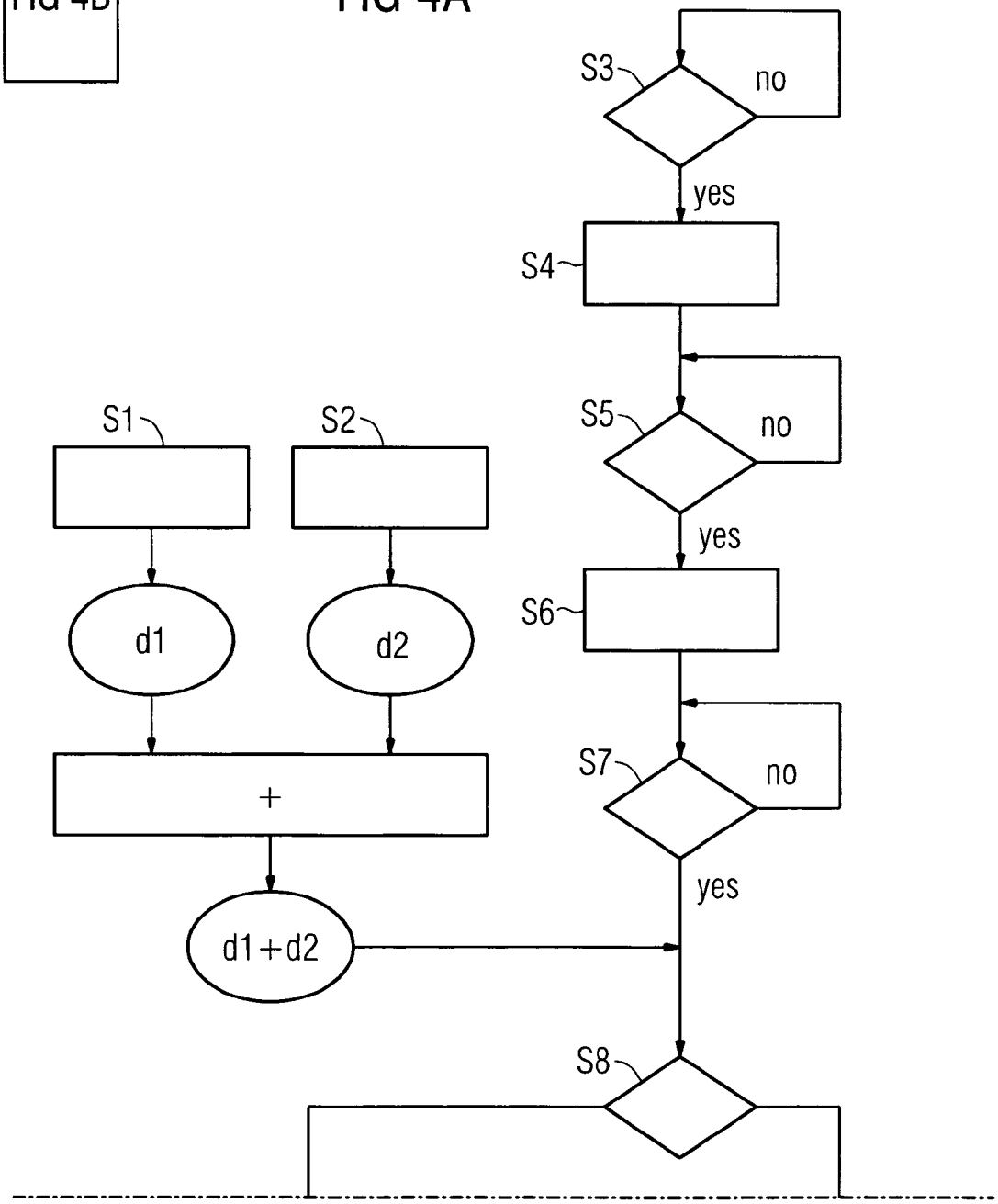

METHOD AND DEVICE FOR DIVERTING FLAT OBJECTS

CROSS-REFERENCE TO RELATED APPLICATIONS

The present application claims priority to German Application No. DE 10 2006 057 776.0, filed Dec. 7, 2006, the content of which is hereby incorporated by reference.

BACKGROUND OF THE INVENTION

The invention relates to a method and device for transporting two flat objects. The objects are in particular flexible mail items, which are transported in a stacking compartment.

A sorting unit for flat flexible mail items transports every mail item fed to it and outputs it into one of a number of stacking compartments. The sorting unit transports the mail items in a specific initial direction. To remove those mail items which are to go into a specific stacking compartment, these mail items have to be diverted from the initial direction to a target direction.

A method and device for transporting two flat objects are known from EP 0915051 B1. This document describes how a continuous stream of overlapping mail items is produced. This continuous overlapping stream is diverted to the target direction and conveyed into a stacking compartment. Two successive mail items, which are transported into the same stacking compartment, overlap during transport in the target direction.

The drive rollers of the further conveyor belts operate in a start-stop mode with short switching times. The further conveyor belts must be tightly tensioned to transport the mail items reliably. The formation of the continuous overlapping stream functions as long as the mail items are sufficiently flat.

The method disclosed in the above mentioned EP 0915051 B1 reaches its limits when it is used in a sorting unit, which has to be able to sort mail items of very different thicknesses. In particular, thick overlapping mail items can no longer be transported by the two further conveyor belts. It appears to be technically impossible, or at least uneconomical to support a drive roller of a further conveyor belt in a movable manner, so that the distance between the two further conveyor belts can be changed.

SUMMARY OF THE INVENTION

An object of the invention is to provide a method and device for transporting two flat objects, which prevent one of the two objects becoming jammed when being diverted to or transported in the target direction in the guiding facility.

According to the invention provision is made for two flat objects to be transported one behind the other in an initial direction. During the transport there is a gap present between the objects. The leading object is diverted to a target direction. A guiding facility next transports the leading object in the target direction and then stops it.

The sum of the thicknesses of the two objects is determined. If the sum of the thicknesses is less than or equal to a predetermined thickness limit, the following steps are executed: As soon as the following object reaches a specific position during transport in the initial direction, continuation of the transport of the leading object is triggered. This triggering takes place in such a manner that the following object moves onto the leading object when diverted and overlaps the leading object at least intermittently when transported in the target direction.

If the sum of the thicknesses is greater than the thickness limit, continuation of the transport of the leading object is similarly triggered. This triggering takes place in contrast in such a manner that a gap remains between the leading object and the following object. This gap is maintained both during diversion to and during further transport in the target direction. As a result thick objects do not overlap. Thicker objects specifically, for example, letters are generally more stable than thin ones, so the thicker objects do not have to be transported in an overlapping manner.

This invention makes it possible to divert both thin and thick objects from the initial direction to the target direction. It is not necessary to sort or classify the objects to be transported and diverted by thickness beforehand. The invention also means that it is not necessary to configure the guiding facility in such a manner that it adjusts to objects of different thicknesses. Rather the invention makes it possible to use the same guiding facility for objects of different thicknesses. Because thin objects overlap during further transport in the target direction, they do not collide at the edges and bend.

The different handling of thinner objects (the sum of the thicknesses is less than or equal to the thickness limit) and thicker objects is preferably effected as follows: In the case of thicker objects continuation of the transport of the leading object is triggered earlier than in the case of thinner objects. The earlier triggering means that the following object does not "catch" the leading object, rather a gap is created between the two objects when they are transported further in the target direction. In contrast the later triggering causes the following object to "catch" the leading object so that the two objects are transported in an overlapping manner in the target direction.

The method is preferably used for a sequence of successive objects, in each instance being applied to a pair of directly consecutive objects. After being diverted and transported in the target direction the following object becomes the leading object with other objects following.

BRIEF DESCRIPTION OF THE SEVERAL VIEWS OF THE DRAWINGS

The novel features and method steps characteristic of the invention are set out in the claims below. The invention itself, however, as well as other features and advantages thereof, are best understood by reference to the detailed description, which follows, when read in conjunction with the accompanying drawings, wherein:

DETAILED DESCRIPTION OF THE INVENTION

In the exemplary embodiment the objects to be transported are flat flexible mail items. The term "mail items" refers in particular to standard and large letters as well as postcards and flat merchandise mailings.

Different mail items with different dimensions are processed by the same sorting unit. This sorting unit transports each mail item and outputs it into one of a number of stacking compartments. To do this, the sorting unit identifies the destination address of each mail item. The stacking compartment into which a mail item is output is a function of the destination address. In each stacking compartment the mail items are preferably stacked with front edge and bottom edge alignment. The mail items are stacked with their surfaces adjacent to each other. The mail items are to be stacked in the stacking compartment in the order in which they pass along the conveyor belts and the further conveyor belts.

The sorting unit transports the mail items first in a specific initial direction. To remove those mail items which are to go into a specific stacking compartment, the mail items have to be diverted from the initial direction to a target direction. There is an acute angle $\alpha$ of 30 degrees, for example, between the initial direction and the target direction. After being transported into the stacking compartment, the mail items strike a wall of the stacking compartment, which is at right angles to the target direction. This causes the front edges of the mail items to become aligned.

It is possible for a stacking spindle (a type of rotatable worm screw) to move the mail item in a stacking direction perpendicular to the target direction after it has struck the wall. Or a hook element or a rotating pillar moves intermittently between two successive mail items during diversion. Nevertheless it can happen that a following mail item collides with the mail item preceding it in such a manner that the leading or following mail item becomes bent or twisted and a mail item becomes damaged or a jam occurs.

It is possible to prevent this by making the gap between two successive mail items very large. However then the throughput of mail items is inadequate.

In the exemplary embodiment a different method is used to avoid the risk of bending or damage and yet still to achieve a high throughput: the formation of a continuous stream of overlapping mail items.

The sorting unit transports and sorts mail items of different thicknesses. These mail items are not sorted as a function of their thickness but as a function of their destination address, for example, to allow a mail deliverer to follow a specific round. The thicknesses of successive mail items can therefore vary to any degree—within specific limits. The invention means that it is not necessary to handle thicker mail items separately, which would require time and outlay. Rather according to the invention any sequence with thicker and thinner mail items is diverted.

Figure 1:
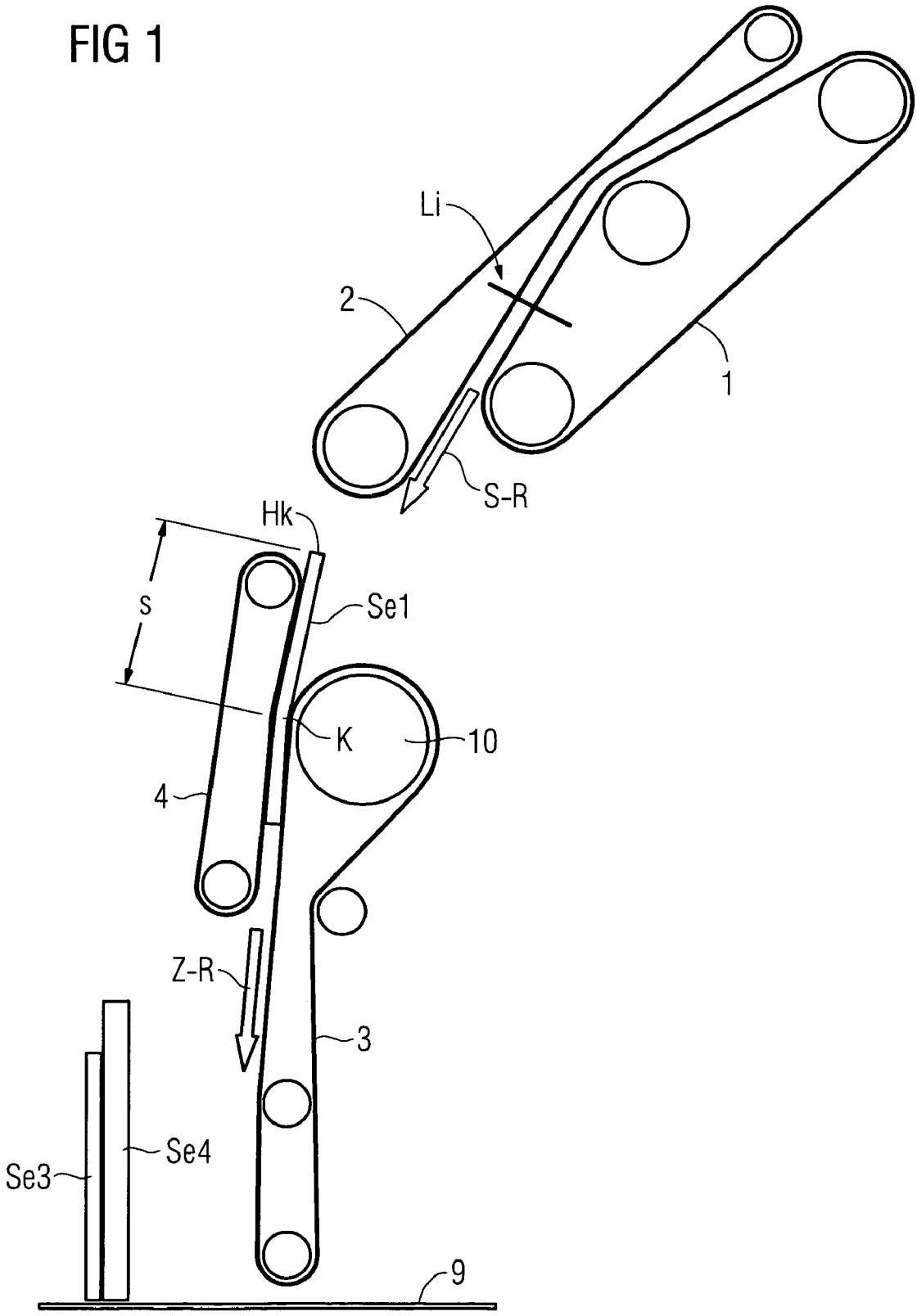
FIG. 1 shows the arrangement of an exemplary embodiment before diversion of the following mail item with the leading mail item stopped.

FIG. 1 shows an arrangement for executing the invention. For purposes of clarity some distance is shown between the drive rollers and the conveyor belts.

The arrangement comprises two rear endless conveyor belts 1, 2 and two further endless conveyor belts 3, 4, when viewed in the initial direction S-R. These four endless conveyor belts are tightly tensioned and made of an elastic material, so that they can transport flat mail items without slippage and without damage. The arrangement also comprises a light barrier Li, whose light beam is interrupted by mail items, when the mail items are transported by the two conveyor belts 1, 2 in the initial direction S-R. A controller receives measurement values from the light barrier Li and activates the drive unit for the drive rollers of the further conveyor belts 3, 4.

FIG. 1 also shows a transverse wall 9 of a stacking compartment. This transverse wall 9 aligns a number of mail items Se3, Se4.

A mail item Se1 is transported first in the initial direction S-R, between the two rear endless conveyor belts 1, 2. The mail item Se1 exits above the two rear conveyor belts 1, 2 and strikes the further tight endless conveyor belt 4. This diverts the mail item Se1 in the target direction Z-R and conveys it further. The mail item Se1 is drawn between the two further conveyor belts 3, 4 and transported further. In this process the mail item Se1 is bent around the rear drive roller 10 of the second further conveyor belt 3—viewed in the target direction.

The mail item Se1 is stopped, as soon as there is a predetermined distance s present between the bending point K (the center point of the bent section of the mail item Se1) and the rear edge Hk1 of the mail item Se1 (viewed in the target direction Z-R). This is achieved by stopping the drive rollers of the further conveyor belts 3, 4.

The controlled stopping means that the rear edge Hk1 of a stopped mail item Se1 is always in the same position.

In order to stop the leading mail item Se1 in a precise position, the light barrier Li reports to the controller, when the rear edge Hk1 of the mail item Se1 has passed the light barrier Li. Because the transport speed is predetermined, it can be ascertained when the leading mail item Se1 reaches the position shown in FIG. 1, in which the distance s occurs. After the expiry of a predetermined time period T0 the controller causes the further conveyor belts 3, 4 to stop the leading mail item Se1. This time period T0 starts at the point when the rear edge Hk1 of the leading mail item Se1 has passed the light barrier L11.

In this stopped position the rear section, having length s, is only in contact with the first further conveyor belt 4. The front section is clamped between the two further conveyor belts 3, 4. Because the mail items can have different lengths, the length of the front section also varies from length to length (e.g. between 127 and 292 mm).

The stopped mail item Se1 remains in the stopped position shown in FIG. 1 until a further mail item Se2 has passed the light barrier Li. The stopped mail item Se1 functions as the leading mail item, the further mail item Se2 as the following mail item.

According to the invention the thickness of each mail item is measured and buffered. Procedures are known for example from DE 4216146 C1, DE 10319723 B3 and US 2005280833 A1 for measuring the thickness of a moving flat mail item in a contactless manner. Other methods for measuring thickness can also be applied.

These thickness measurements are taken while the mail items are being transported in the initial direction S-R or even earlier, at any rate before diversion to the target direction Z-R. The thickness of each mail item is preferably measured "at full steam," in other words without slowing the mail item down.

The measured thicknesses d1, d2 of two successive mail items Se1, Se2, which are both to be diverted to the target direction Z-R, are added together. A thickness sum is thus calculated.

It is checked whether or not the sum of the thickness d1 of the leading mail item Se1 and the thickness d2 of the following mail item Se2 exceeds a predetermined thickness limit DS. The thickness limit DS is preferably twice the maximum thickness of a standard letter, e.g. 2*6.5 mm=13 mm. The thickness limit DS can be adjusted to different requirements, for example a different volume of mail items, without having to modify further components to the requirement.

If the thickness sum d1+d2 is smaller than or equal to the thickness limit DS, the two mail items Se1, Se2 are diverted in such a manner that they overlap when transported in the target direction.

The light barrier Li measures when a following and as yet undiverted mail item Se2 has passed the light barrier Li. The trigger event for continuation of transport is that the front edge Vk2 of Se2 passes the light barrier Li. The controller activates the drive unit of the further conveyor belts 3, 4 in such a manner that the further conveyor belts operate in a start-stop mode. At the time of or after the trigger event the controller restarts the drive unit. As a result the further conveyor belts 3, 4 accelerate the leading mail item Se1 to a predetermined transport speed.

The following mail item Se2 is first transported further simultaneously at the same transport speed in the initial direction S-R. Its front edge Vk2 then strikes the moving leading mail item Se1, in such a manner that there is a predetermined distance c between the meeting point and the rear edge Hk1 of the leading mail item Se1. The leading mail item Se1 and the following mail item Se2 describe what is known as the insertion triangle. The insertion triangle has an acute angle, which is equal to the angle α between the initial direction S-R and the target direction Z-R.

This causes the leading mail item and the following mail item to overlap in a region of length c—measured in the target direction. This overlap region is limited by the rear edge Hk1 of the leading mail item Se1 and the front edge Vk2 of the following mail item Se2. The distance between the rear edge Hk1 and the front edge Vk2 is precisely c.

Figure 2:
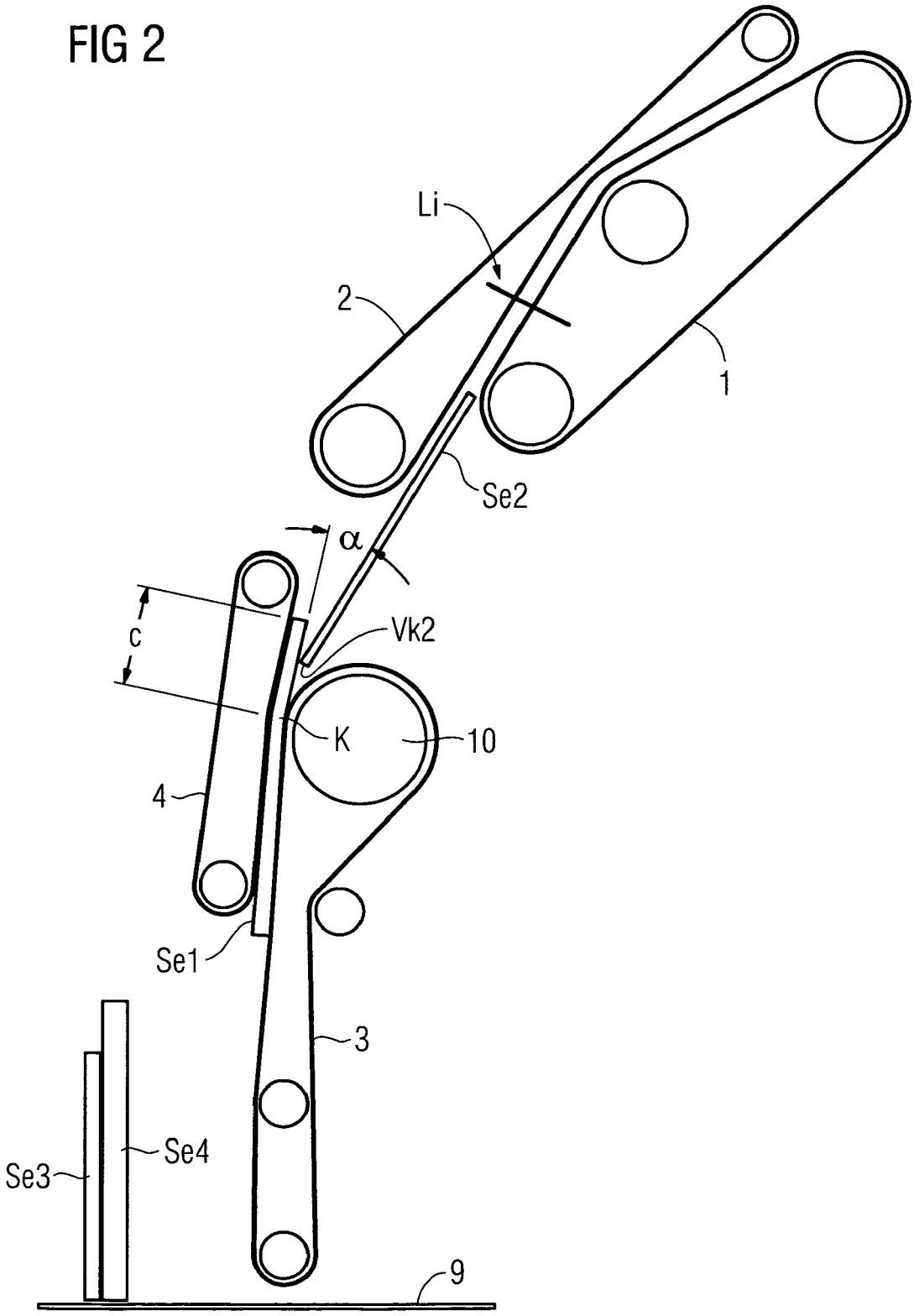
FIG. 2 shows the arrangement in FIG. 1 if two thin mail items at the point when the following mail item moves onto the leading mail item.

FIG. 2 shows the arrangement in FIG. 1 in the case of two thin mail items at the point when the following mail item Se2 moves onto the leading mail item Se1.

The leading mail item Se1 is in contact with the tight further conveyor belt 4 and there is an acute angle between the initial direction S-R and the target direction Z-R. The moving leading mail item Se1 therefore diverts the following mail item Se2 to the target direction Z-R. The following mail item Se2 similarly moves between the two further conveyor belts 3, 4 and is transported in the target direction Z-R.

The front edge Vk2 of the following mail item Se2 activates the drive rollers of the further conveyor belts 3, 4, its rear edge deactivates them again. The following mail item Se2 then becomes the leading mail item, its rear section with length s only being in contact with one further conveyor belt 4.

This causes a continuous stream of overlapping mail items to be formed. The continuous overlapping stream strikes the wall of the stacking compartment. The overlap prevents a collision between mail items as they strike the transverse wall 9 of the stacking compartment. This invention functions better than a stacking spindle.

This method is implemented when the thickness sum is less than or equal to the thickness limit.

The following mail item Se2 "catches" the leading mail item Se1. The further conveyor belts 3, 4 are started for this purpose in such a manner that the two mail items Se1, Se2 overlap by c when transported by the two conveyor belts 3, 4. For standard letters the advantageous and technically feasible overlap is achieved as a continuous overlapping stream. A variation of the method described above is preferably implemented here: The further conveyor belts are not started immediately after the front edge Vk2 of the following mail item Se2 reaches the light barrier Li but only after the expiry of a predetermined time limit. The measuring light barrier Li is moved upstream for example—viewed in the initial direction S-R—compared with the refinement in EP 0915051 B1.

In an alternative variation compared with the refinement in EP 0915051 B1, the drive rollers accelerate the further conveyor belts more slowly, when the thickness sum is less than or equal to the thickness limit.

In contrast if the thickness sum is greater than the thickness limit, overlapping of the two successive mail items is prevented. For this purpose the two further conveyor belts are started early so that the leading mail item Se1 and the following mail item Se2 do not overlap. Rather a gap again results between the two mail items Se1, Se2, when the two further conveyor belts 3, 4 transport the two mail items Se1, Se2 in the target direction Z-R. This gap can be just as large as the gap during previous transport in the initial direction or can be different from that gap.

Figure 3:
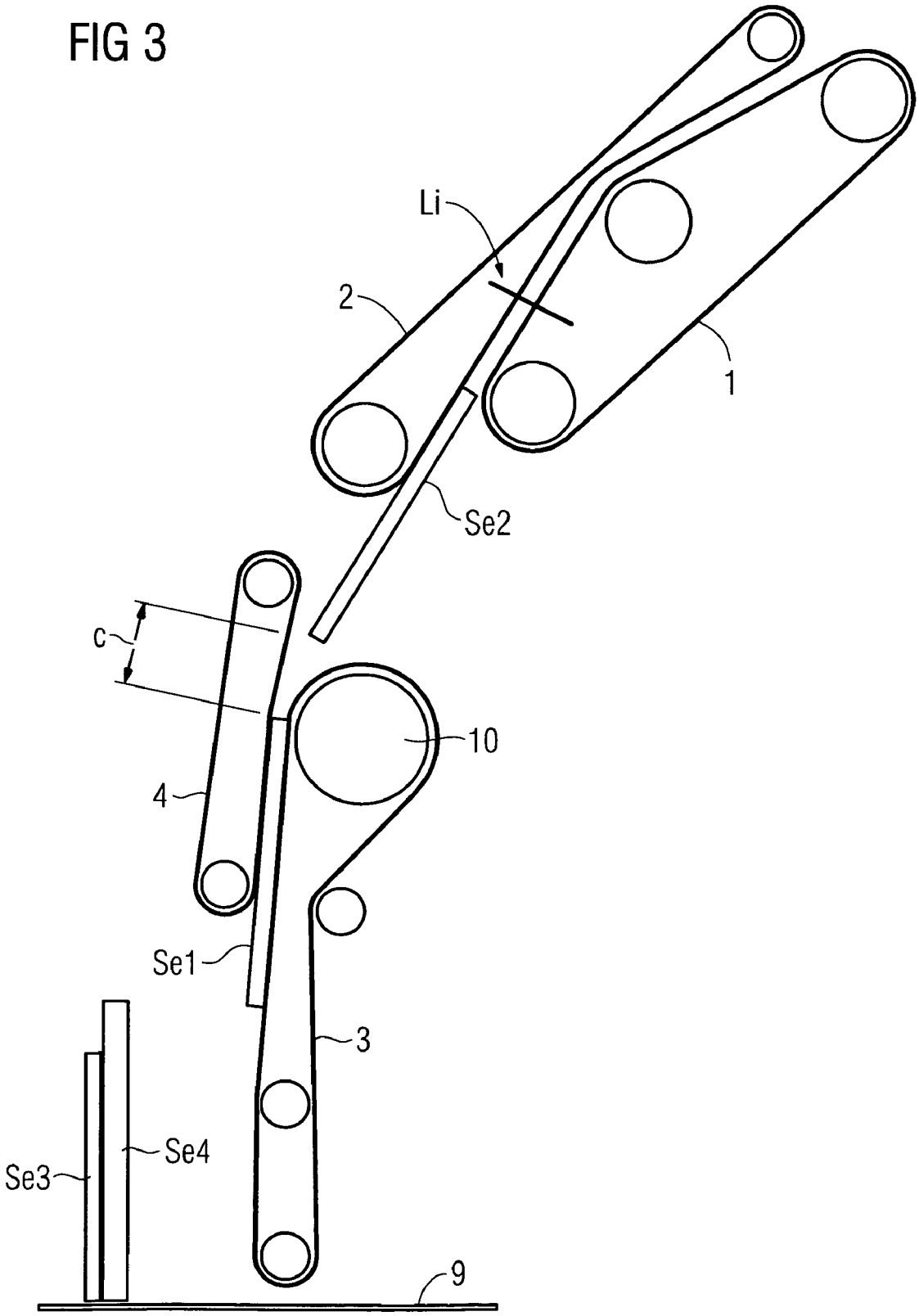
FIG. 3 shows the arrangement in FIG. 1 if two thick mail items at the point when the following mail items moves onto the leading mail item.

FIG. 3 shows the arrangement in FIG. 1 in the case of two thick mail items at the point when the following mail item Se2 moves onto the leading mail item Se1.

The continuous overlapping stream is formed to prevent the following: the front edge of the leading mail item Se1 is in contact with the transverse wall wand 9 of the stacking compartment. The front edge of the following mail item Se2 strikes the rear edge of the adjacent leading mail item Se1. This can cause mail items in particular to become bent as a result. This can result in bending, a jam or even damage to mail items in the stacking compartment. In particular mail items with little inherent rigidity in particular tend to bend when stacked.

The invention provides for two successive mail items not to be overlapped only if the two mail items are relatively thick. It is precisely these mail items which are however generally relatively rigid and do not bend. These very mail items can therefore be transported into the stacking compartment and be stacked there without being overlapped.

The sorting unit has a controller, which activates and deactivates the drive unit for rotating the further conveyor belts 3, 4. The controller is connected to the light barrier Li and receives measurement signals from it. If the rear edge Hk1 of the leading mail item Se1 has passed the light barrier Li, the controller stops the drive unit of the further conveyor belts 3, 4. This causes the leading mail item Se1 to be stopped in such a manner that there is the distance s between its rear edge and the bending point.

As soon as the front edge Vk2 of the following mail item Se2 has passed the light barrier Li, this event is transmitted to the controller. The controller checks whether the thickness sum d1+d2 is less than or greater than the thickness limit DS. The controller preferably reads the value d1+d2 of the thickness sum from a data storage unit.

The controller activates the drive unit of the further conveyor belts 3, 4 after the front edge Vk2 has passed the light barrier Li. The time period between the time when the front edge Vk2 passes the light barrier Li and the time when the controller reactivates the drive unit is a function of the thickness sum d1+d2 and is set by the controller. If the thickness sum is less than or equal to the thickness limit DS, the time period is equal to a predetermined first value T1. Otherwise it is equal to a predetermined second value T2.

The controller decides automatically and as a function of the thickness sum d1+d2 which value is applied and reads out the value to be applied in each instance from a data storage unit. The second value T2 is smaller than the first value T1. As a result the controller brings about the following: in the case of a large thickness sum d1+d2 the drive unit is started earlier (after expiry of the shorter second time period), and the leading mail item is transported earlier in the target direction. The mail items do not overlap. In the case of a small thickness sum d1+d2 the drive unit is started later (after expiry of the longer first time period) and the leading mail is transported later in the target direction Z-R. The mail items overlap.

Figure 4B:
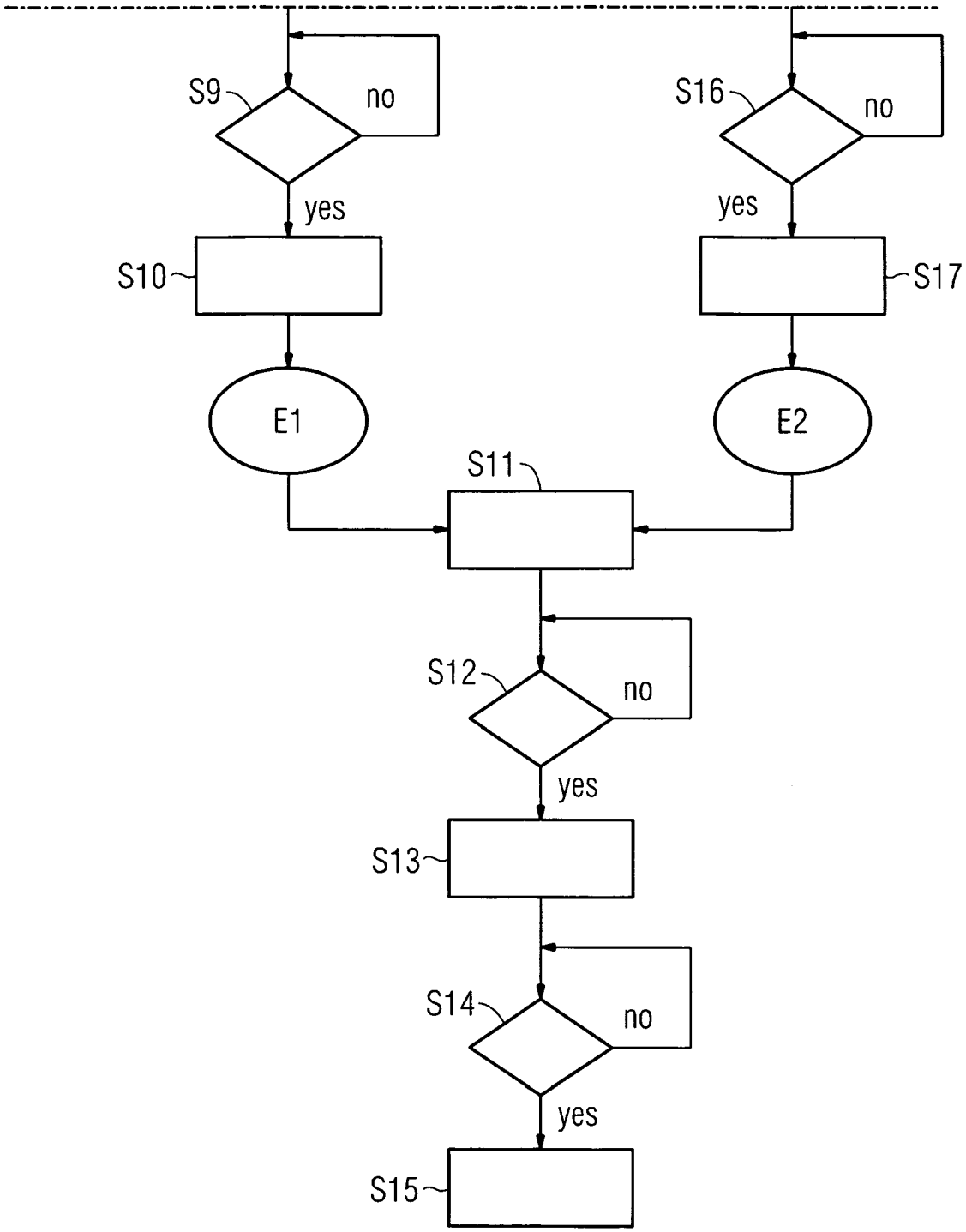
FIG. 4 shows a flow diagram, illustrating the method in the exemplary embodiment.

FIG. 4 shows a flow diagram illustrating the method of the exemplary embodiment. In this flow diagram the steps have the following significance:

- S1 Measure the thickness d1 of the leading mail item Se1
- S2 Measure the thickness d2 of the following mail item Se2
- S3 Has the rear edge Hk1 of the leading mail item Se1 reached the light barrier Li?
- S4 Transport the leading mail item Se1 further by means of the rear conveyor belts 1, 2. Divert mail item Se1.
- S5 Has the time period T0 elapsed?
- S6 Keep Se1 stopped. Transport the following mail item Se2 by means of the rear conveyor belts 1, 2.
- S7 Has the front edge Vk2 of the following mail item se2 reached the light barrier Li?

S8 Is the thickness sum d1+d2 less than or equal to the thickness limit DS?

S9 Has the time period T1 elapsed?

S10 Start the further transport of Se1

E1 Se2 strikes Se1

S11 Transport the overlapping mail items Se1 and Se2 further by means of the further conveyor belts 3, 4.

S12 Has the rear edge Hk2 of the following mail item Se2 reached the light barrier Li?

S13 Transport the following mail item Se2 further by means of the rear conveyor belts 1,2. Divert mail item Se2.

S14 Has the time period T0 elapsed?

S15 Keep Se1 stopped . . . .

S16 Has the time period T2 elapsed?

S17 Start the further transport of Se1.

E2 A gap remains between Se1 and Se2.

In one embodiment, a minimum gap L is predetermined. This minimum gap L is to be located between two successive mail items, when the mail items are transported after being diverted to the target direction. It is checked whether the leading mail item can be transported so far in the target direction that a gap of length L can result between the rear edge of the leading mail item and the front edge of the following mail item.

If for example the transverse wall of the stacking compartment, which limits transport and which the mail items strike, is near, this may not be possible. In the embodiment, therefore, the length of each mail item is also measured before it reaches the light barrier Li. Let S1 be the length of the leading mail item Se1. Let y be the path the front edge of a mail item still has to cover to the transverse wall of the stacking compartment, after it has been stopped. This path is only a function of the sorting unit not of the mail items. It is checked whether S1+L<=y. If so, the further conveyor belts transport the leading mail item so far that the gap L occurs between the leading mail item and the following mail item Se2. If in contrast S1+L>y, the gap L cannot be produced. In this instance the further conveyor belts 3, 4 transport the two mail items until the rear section of the following mail item Se2 has the length s. The leading mail item Se1 has then already collided with the transverse wall 9.

I claim:

1. A method for transporting two flat objects, comprising:

transporting a leading object and a following object in an initial direction such that a gap is present between them, wherein each object has a thickness;

diverting the leading object to a target direction;

transporting the leading object by a guiding facility in the target direction;

stopping the leading object by the guiding facility;

if the following object has reached a specific position during transport in the initial direction, triggering by the guiding facility a continuation of the transport of the leading object;

diverting the following object to the target direction;

transporting the following object by the guiding facility in the target direction;

determining a sum of the thicknesses of the two objects;

if the thickness sum is less than or equal to a predetermined thickness limit, triggering continuation of the transport of the leading object such that the following object moves onto the leading object when diverted and overlaps the leading object when transported in the target direction; and if the thickness sum is greater than the thickness limit, triggering continuation of the transport of the leading object such that a gap exists between the leading object and the following object, both when the following object is diverted and when it is transported in the target direction.

2. The method of claim 1, further comprising:

if the thickness sum is less than or equal to the thickness limit, triggering continuation of the transport of the leading object such that it starts to be transported when a predetermined first time period has elapsed, after the following object has reached the specific position, and if the thickness sum is greater than the thickness limit, triggering continuation of the transport of the leading object such that it starts to be transported when a predetermined second time period has elapsed after the following object has reached the specific position, with the second time period being shorter than the first time period.

3. The method of claim 2, further comprising ascertaining when a front edge of the following object reaches a specific point, and starting the first time period and the second time period when the front edge reaches the specific point.

4. The method of claim 2, wherein the second time period is zero.

5. The method of claim 1, wherein the two objects are transported at a same speed in the target direction after diversion.

6. The method of claim 5, further comprising:

measuring a length of the leading object;

limiting the transport of the objects in the target direction by a predetermined fixed end point;

if a distance over which the leading object is to be transported between continuation of transport and reaching the end point is greater than the sum of the length of the leading object and a predetermined gap limit, stopping transport of the two objects by the guiding facility as soon as the following object reaches a specific further position; and if the distance is less than the sum, continuing transport of the two objects until the leading object has reached the end point.

7. The method of claim 1, wherein an acute angle exists between the initial direction and the target direction, and, if the thickness sum is less than or equal to the thickness limit, the following object is transported such that it moves onto the leading object at this acute angle.

8. The method of claim 1, further comprising ascertaining when a rear edge of the following object reaches a specific point; and stopping transport of the leading object by the guiding facility when the rear edge reaches said point.

9. The method of claim 1, further comprising ascertaining when a front edge of the following object reaches a specific point, and triggering continuation of the transport of the leading object by the guiding facility when a front edge of the following object reaches this point.

10. The method of claim 1, wherein determining the thickness sum comprises:

measuring the thickness of the leading object before diversion;

measuring the thickness of the following object before diversion; and adding the two measured thicknesses.

11. The method of claim 1, wherein the guiding facility stops the leading object such that a front section—viewed in the target direction—of the leading object is fixed, and a remaining rear section to the rear edge of the leading object has a length, which is equal to a predetermined amount.

12. The method of claim 1, further comprising:

limiting the transport of the objects in the target direction by a fixed transport end point;

predetermining a minimum distance between two successive objects, which is to be maintained during transport in the target direction, if the two objects do not overlap;

measuring a length of the leading object;

if the thickness sum is greater than the thickness limit, determining a sum of the measured length and the predetermined minimum distance;

if the sum of the measured length and the minimum distance is greater than or equal to a remaining transport path to the transport end point after the leading object has been stopped, stopping the further transport in the target direction by the guiding facility after the diversion of both objects; and if the sum of the measured length and the minimum distance is less than the transport path, continuing the further transport until the leading object reaches the transport end point (9).

13. The method of claim 1, further comprising:

transporting a further following flat object in the initial direction such that it follows the following object with a gap in-between;

determining a sum of the thicknesses of the following object and the further following object; and continuing the transport of the following object by the guiding facility such that, if the thickness sum is less than or equal to the thickness limit the following object and the further following object overlap, and, if the thickness sum is greater than the thickness limit, a gap exists between the following object and the further following object.

14. A device for transporting two flat objects, comprising means for transporting the objects in an initial direction such that a gap exists between the two objects, wherein each object has a thickness;

a guiding facility for diverting the objects to a target direction and for transporting the objects further in the target direction;

a measuring facility for determining a sum of the thicknesses of the two objects; and a controller for activating the guiding facility, wherein the controller is coupled to the measuring facility and configured to:

activate the guiding facility such that it diverts the leading object and transports it in the target direction;

stop the guiding facility after it has transported the leading object some distance in the target direction;

to trigger a start of the guiding facility when the following object has reached a specific position during transport in the initial direction and to trigger transport of the leading object by means of the guiding facility; and to trigger diversion and further transport of the following object in the target direction by means of the guiding facility, wherein to trigger the start of the guiding facility, the controller is configured such that the guiding facility:

continues transport of the leading object such that the following object moves onto the leading object when diverted and overlaps the leading object when transported in the target direction, if the thickness sum is less than or equal to the predetermined thickness limit, and continues transport of the leading object such that a gap exists between the leading object and the following object, both when the following object is diverted and also when it is transported in the target direction, if the thickness sum is greater than the thickness limit.

15. The device of claim 14, wherein the controller is configured to:

trigger continuation of the transport of the leading object such that it starts to be transported when a predetermined first time period has elapsed after the following object has reached the specific position, if the thickness sum is less than or equal to the thickness limit, and to trigger continuation of the transport of the leading object such that it starts to be transported when a predetermined second time period has elapsed after the following object has reached the specific position, if the thickness sum is greater than the thickness limit, wherein the second time period is shorter than the first time period.

16. A unit for stacking flat objects automatically, comprising:

a compartment for receiving objects, which is disposed such that it can be reached by the objects by means of transport in the target direction; and a device for transporting two flat objects, the device comprising means for transporting the objects in an initial direction such that a gap exists between the two objects, wherein each object has a thickness;

a guiding facility for diverting the objects to a target direction and for transporting the objects further in the target direction;

a measuring facility for determining a sum of the thicknesses of the two objects; and a controller for activating the guiding facility, wherein the controller is coupled to the measuring facility and configured to:

activate the guiding facility such that it diverts the leading object and transports it in the target direction;

stop the guiding facility after it has transported the leading object some distance in the target direction;

to trigger a start of the guiding facility when the following object has reached a specific position during transport in the initial direction and to trigger transport of the leading object by means of the guiding facility; and to trigger diversion and further transport of the following object in the target direction by means of the guiding facility, wherein to trigger the start of the guiding facility, the controller is configured such that the guiding facility:

continues transport of the leading object such that the following object moves onto the leading object when diverted and overlaps the leading object when transported in the target direction, if the thickness sum is less than or equal to the predetermined thickness limit, and continues transport of the leading object such that a gap exists between the leading object and the following object, both when the following object is diverted and also when it is transported in the target direction, if the thickness sum is greater than the thickness limit.

* * * * *